252-105 AU 166 EX
1/27/81 XR 4,247,342

United States Patent [19]
Kuhn

[11] 4,247,342
[45] Jan. 27, 1981

[54] METHOD AND COMPOSITION FOR REMOVING ETHYLENE GLYCOL TEREPHTHALATE OLIGOMER DEPOSITS AND DYESTUFF RESIDUE FROM TEXTILE DYEING EQUIPMENT

[75] Inventor: Hans H. Kuhn, Spartanburg, S.C.

[73] Assignee: Milliken Research Corporation, Spartanburg, S.C.

[21] Appl. No.: 909,227

[22] Filed: May 24, 1978

[51] Int. Cl.[3] ..... B08B 3/08
[52] U.S. Cl. ..... 134/2; 134/29; 134/30; 134/38; 252/105
[58] Field of Search ..... 134/2, 22 R, 29, 30, 134/38; 252/105, 156, 547; 8/137.5

[56] References Cited

U.S. PATENT DOCUMENTS

| | | | |
|---|---|---|---|
| 3,485,670 | 12/1969 | Fisher | 134/29 X |
| 3,553,143 | 1/1971 | Bauer | 252/547 X |
| 3,761,429 | 9/1973 | Yamano et al. | 252/547 |
| 3,865,628 | 2/1975 | Callahan et al. | 134/22 R X |

FOREIGN PATENT DOCUMENTS

| | | | |
|---|---|---|---|
| 2403859 | 8/1975 | Fed. Rep. of Germany | 8/173 |

*Primary Examiner*—Marc L. Caroff
*Attorney, Agent, or Firm*—H. William Petry; Terry T. Moyer

[57] ABSTRACT

Ethylene glycol terephthalate oligomer deposits and dyestuff residue are removed from textile dyeing equipment by contacting the deposits and residue with an aqueous composition at a temperature of from about 90° C. to about 140° C.; the aqueous composition consisting essentially of water, an effective amount of a base component to provide the aqueous admixture with a pH of at least about 11.5, an effective minor amount of a phase transfer agent sufficient to catalytically hydrolyze the oligomer deposits present within the textile dyeing machinery, and an effective minor amount of a cationic or nonionic surfactant to solubilize the dyestuff residue present in the textile dyeing machinery. The composition can further include an effective minor amount of a reducing agent to substantially discolor the solubilized dyestuff.

12 Claims, No Drawings

METHOD AND COMPOSITION FOR REMOVING ETHYLENE GLYCOL TEREPHTHALATE OLIGOMER DEPOSITS AND DYESTUFF RESIDUE FROM TEXTILE DYEING EQUIPMENT

This invention relates to a method and composition for removing ethylene glycol terephthalate oligomer deposits and dyestuff residue from textile dyeing equipment.

Ethylene glycol terephthalate oligomer, and particularly the trimer, are deposited on the surface of dyeing equipment during the pressure dyeing of polyester. In addition, dyestuff residue buildup occurs and is likewise deposited on the surface of the dyeing equipment and/or trimer deposits during pressure dyeing processes. Such has occurred because in the process of high temperature dyeing the oligomers leave the polyester fiber and are exuded to the surface. The rate of desorption of this material into the dye liquor depends upon the various carriers, temperatures, and times involved in the dyeing operation. The longer the cycle is held at the maximum temperature and the more carrier present, the more of the material is transported into the dye liquor. This material, which is transported into the dye liquor, has a tendency to plate out on the stainless steel equipment in which the dyeings are conducted and the equipment requires frequent scouring under highly alkaline conditions in order to remove the material from the surface. Cleaning operations are necessary for basically two reasons. One to provide continuous, proper heat transfer in such units as the heat exchanger to provide continuous and proper agitation in the pump. If the impeller is entirely coated with trimer its efficiency is lessened and most important as one goes through darker and darker dyeings, one can not switch to lighter colors without removing the trimer color combination deposited in the equipment because one would obtain dye stains. Such cleaning operations so far, have not been entirely successful, and the use of a sodium hydroxide solution, by itself, usually leaves considerable amounts of the oligomer deposits present within the textile dyeing machinery. Further problems have been encountered in that dyestuff residues are likewise deposited on the surface of the equipment which must be likewise removed.

The use of catalytic amounts of phase transfer agents, such as organic quaternary salts, and the like in combination with a caustic aqueous medium have long been recognized as being effective for hydrolyzing esters. However, while such has been known, problems have nevertheless been encountered in the use of compositions containing the base component and a phase transfer agent in that often insufficient hydrolysis of the oligomer occurs and numerous other problems, such as dyestuff residue deposits remain in the textile dyeing equipment, especially after the dyeing of polyester. Much effort has been directed toward improved methods and compositions for removing oligomer deposits and dyestuff residue from textile dyeing equipment in an effort to allow one to readily remove such contaminates from the dyeing equipment to insure that during subsequent dyeing operations and cycles such oligomer deposits and dyestuff residue do not interfere with the dyeing process and thereby result in off-quality products. Thus, improved methods and compositions are constantly being sought which will enable one to readily remove ethylene glycol terephthalate oligomer deposits and dyestuff residue from textile dyeing equipment. Further, in order for such method and composition to be economically feasible, one should be able to clean the textile dyeing material of such oligomer deposits and dyestuff residue in a minimum of time.

Therefore, an object of the present invention is to provide a new and improved composition and method of using same for removing ethylene glycol terephthalate oligomer deposits and dyestuff residue from textile dyeing equipment.

Another object of the present invention is to provide an improved composition and method for using same for removing ethylene glycol terephthalate oligomer deposits and dyestuff residue from textile dyeing equipment which does not cause formation of undesirable and hard to remove by-products in the textile dyeing equipment.

Another object of the invention is to provide an improved composition and method for removing oligomer deposits and dyestuff residue from textile dyeing equipment which does not require that the equipment be inoperative for long periods of time.

These and other objects, advantages, and features of the present invention will become apparent to those skilled in the art from a reading of the following description and appended claims.

According to the present invention, I have found an improved composition and method for using same for removing ethylene glycol terephthalate oligomer deposits and dyestuff residue from textile dyeing equipment. Broadly, the composition is an aqueous admixture consisting essentially of water, an effective amount of a base component to provide the aqueous admixture with a pH of at least about 11.5, an effective minor amount of a phase transfer agent to sufficiently hydrolyze the oligomer deposits within the textile dyeing material, and an effective minor amount of a surfactant to solubilize the dyestuff residue present within the textile dyeing equipment. The surfactant employed in the aqueous admixture is a cationic or nonionic surfactant characterized as having a cloud point at the effective concentration and above the temperature to which the aqueous admixture is heated during the use of same for removing the oligomer deposits and dyestuff residue from the textile dyeing equipment.

Further, according to the invention, I have found an improved method for removing ethylene glycol terephthalate oligomer deposits and dyestuff residue from textile dyeing equipment using the before mentioned aqueous admixture. Broadly, the method comprises introducing into the textile dyeing equipment an aqueous admixture having a pH of at least about 11.5 and containing an effective minor amount of a phase transfer agent to sufficiently hydrolyze the oligomer deposits present within the textile equipment and an effective minor amount of a cationic or nonionic surfactant to solubilize the dyestuff residue, heating the aqueous admixture within the textile dyeing equipment to a temperature of from about 90° C. to about 140° C., maintaining the heated aqueous admixture within the textile dyeing equipment for a period of time effective to hydrolyze the oligomer deposits and solubilize the dyestuff residue, and thereafter withdrawing the aqueous admixture contaminated with the hydrolyzed oligomer deposits and solubilized dyestuff residue from the textile dyeing equipment.

The aqueous composition employed for removing ethylene glycol terephthalate oligomer deposits and dyestuff residue from textile dyeing equipment of the present invention is a multicomponent system which consists essentially of water, a base component, a phase transfer agent and a surfactant. In addition, it is often desirable to incorporate within the aqueous admixture a reducing agent to substantially discolor the solubilized dyestuff. The amount of each of the before mentioned constituents present in the aqueous admixture can vary widely, provided however, that the amount of base component employed is that amount sufficient to provide the aqueous admixture with a pH of at least about 11.5, the amount of a phase transfer agent is sufficient to hydrolyze the oligomer deposits within the textile dyeing equipment, and the amount of surfactant employed is sufficient to solubilize dyestuff residue present within the textile dyeing equipment. Further, when it is determined desirable to incorporate within the aqueous admixture, the reducing agent, the amount employed is that amount sufficient to substantially discolor the solubilized dyestuff so that upon withdrawing the contaminated aqueous admixture from the textile dyeing equipment, the contaminated aqueous admixture is substantially clear, thus insuring no color deposits within the textile dyeing equipment and further reducing problems on waste disposal.

While the amount of each of the constituents can vary widely, I have found that generally one can sufficiently hydrolyze the oligomer deposits within the textile dyeing equipment by incorporating from about 0.005 to about 0.1 weight percent of the phase transfer agent into the aqueous admixture. Similarly, one can solubilize the dyestuff residue by incorporating into the aqueous admixture from about 0.05 to about 0.5 weight percent of the surfactant. When it is determined desirable to substantially discolor the solubilized dyestuff by incorporating a reducing agent into the aqueous admixture, such can generally be achieved by incorporating from about 0.05 to about 1 weight percent of the reducing agent into the aqueous admixture. However, it should be understood that the amount of the base component, phase transfer agent, surfactant, and when desired, reducing agent, employed in the aqueous admixture and its subsequent use for removing ethylene glycol terephthalate oligomer deposits and dyestuff residue from textile dyeing equipment will be dependent to a large degree, upon the amount of oligomer deposits and dyestuff residue present in the textile dyeing equipment. However, it is generally believed that if one will employ a sufficient amount of the base component to maintain the pH of the aqueous admixture at least about 11.5 and incorporate therein the specified amounts of the phase transfer agent, surfactant, and reducing agent, one can, in most situations encountered in a commercial operation, substantially remove such deposits and residue from textile dyeing equipment when following the method as set forth hereinafter.

The base component which can be employed in the preparation of the before mentioned aqueous admixture can be any suitable caustic constituent which is capable of providing the aqueous admixture with a pH of at least about 11.5. However, generally desirable results can be obtained when the base component is an alkali metal hydroxide, such as sodium hydroxide, lithium hydroxide, potassium hydroxide, and the like. For economical reasons and commercially availability, sodium hydroxide is especially desired.

The term "phase transfer agent" as used herein is to be understood to mean any compound which can catalytically increase the rate of hydrolysis of the ethylene glycol terephthalate oligomer deposits present within the textile dyeing equipment. Typical of such phase transfer agents are the organic quaternary salts and crown ethers. Illustrative of crown ethers are 18-crown-6, 15-crown-5, dicyclohexo-18-crown-6, dibenzyl-18-crown-6, 12-crown-4, and the like. The selection of the particular crown ether will be determined, to a large extent, upon the cation of the particular base component employed in the aqueous admixture and the ability of the crown ether to complex with such cation.

Because of the availability of such compounds, the most desired phase transfer agent is an organic quaternary salt. Such organic quaternary salts can be generally represented by the formula

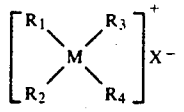

wherein M is a pentavalent ion of an element selected from the group consisting of nitrogen, phosphorous, arsenic, antimony and bismuth, $R_1$, $R_2$, $R_3$ and $R_4$ are saturated or unsaturated alkyl radicals, alkaryl radicals or aryl radicals containing from 1 to about 30 carbon atoms, and X is an ion derived from organic and inorganic acids which will disassociate from the cation portion in an aqueous environment. Examples of suitable alkyl moieties which can be used as $R_1$, $R_2$, $R_3$ and $R_4$ in the above defined organic quaternary salt are methyl, butyl, pentyl, octyl, dodecyl, pentadecyl, octadecyl, eicosyl, pentacosyl, tricosyl, and mixtures thereof as obtained from natural and synthetic products such as fats and oils. The anion X represented in the above mentioned formula of the organic quaternary salt constituent can be any suitable anion which is derived from organic and inorganic acids which will disassociate from the cation portion in an aqueous environment. Generally, the anion is a halide, a sulfate, a sulfonate, or an acetate. Examples of suitable compounds which can be employed as the anion in the organic quaternary salt constituent are chloride, bromide, iodide, sulfate, and acetate.

As previously mentioned, the alkyl, alkaryl or aryl moieties contained in the cation portion of the organic quaternary salt constituent of the aqueous admixture of the present invention can vary over a wide range of about 1 to about 30. However, especially desirable results have been obtained wherein at least 2 of the alkyl radicals of the cation portion of the organic quaternary salt contains more than one carbon atom per moiety. Furthermore, desirable results have been obtained wherein the pentavalent ion of the cation portion is nitrogen and the ion portion is chloride. Illustrative of the organic quaternary salts as described above are dicocodimethylamine chloride, butyl tridodecyl ammonium chloride, ethyl trioctyl ammonium chloride, propyl trioctadecyl ammonium bromide, and the like. Thus, any suitable organic quaternary salt having the general formula as defined above can be employed as the phase transfer agent of the aqueous admixture for use in the method of the present invention. However, in the selection of the organic quaternary salt one must, in his selection, insure that the organic quaternary salt is heat stable at the temperature at which the aqueous admixture is to be heated during the clean out procedure of the textile dyeing equipment.

While the phase transfer agent has been found beneficial, in combination with the base component of the aqueous admixture to hydrolyze the ethylene glycol terephthalate oligomer deposits present within the textile equipment, we have found it necessary, in order to effectively remove dyestuff residue, to incorporate within the aqueous admixture a cationic or nonionic surfactant as hereinbefore specified. Any suitable cationic or nonionic surfactant can be employed provided that such surfactant has a cloud point above the temperature to which the aqueous composition is heated during the use of same for removing the oligomer deposits and dyestuff residue from the textile dyeing equipment. Typical of such nonionic surfactants are the ethoxylated alkyl phenols, ethoxylated aliphatic alcohols, polyoxyalkylene oxide block copolymers, and the like. The choice of the particular nonionic surfactant will be dependent primarily upon the availability of such compounds to the user. However, care must be exercised to insure that the cloud point of such surfactant meets the conditions hereinbefore specified, and that such surfactant will in no way cause undesirable side reactions and/or deposits within the textile dyeing equipment. While any of the above nonionic surfactants can be employed, I have found especially desirable results can be obtained when the nonionic surfactant is an ethoxylated linear $C_{11}$ to $C_{15}$ alcohol containing about 15 moles of ethylene oxide.

It is often desirable, in order to insure complete removal of color producing matter within the textile material and likewise from a waste treatment stand point, to incorporate into the beforementioned aqueous admixture an effective minor amount of a reducing agent to substantially discolor the solubilized dyestuff. Any suitable reducing agent can be employed provided no deleterious side reactions occur between the reducing agent, the components of the aqueous admixture, or the ethylene glycol terephthalate oligomer deposits and dyestuff residue present within the textile dyeing equipment. Typical of such reducing agents are thioureadioxide, sodium borohydride, sodium sulfite, and the like. However, in the selection of the reducing agent care should be employed to insure that the reducing agent does not result in the formation of a sufficient amount of an acid constituent to substantially alter the pH of the aqueous admixture.

In addition to the above-described components, additional constituents can better readily be incorporated into the aqueous admixture without substantially effecting the overall performance of such aqueous composition for the removal of oligomer deposits and dye residue from textile dyeing equipment. For example, if one desires, one can incorporate into the aqueous admixture a dye carrier such as a halogenated hydrocarbon, e.g., methylene chloride, chloroform, 1,2-dichloroethane, perchloroethylene, admixtures thereof, or a suitable aromatic carrier such as -naphthol, methyl naphthalene, para-chloro ortho-benzyl phenol, biphenyl, trichlorobenzene, and the like. When it is determined desirable to incorporate a dye carrier into the aqueous admixture, the amount can vary widely, but will generally be within an amount of from about 0.01 to about 1.0 weight percent. When one desires to incorporate into the aqueous admixture a halogenated hydrocarbon and/or aromatic dye carrier, such as illustrated above, into the aqueous admixture, it may be desirable to likewise incorporate a suitable emulsifier. Such compounds which are useful in dispersing organic liquids in an aqueous phase are well known and typical of such are isopropylamine salt mixtures of ethoxylated nonyl phenols, and the like.

The aqueous composition, as described above, can be readily employed for removing ethylene glycol terephthalate oligomer deposits and dyestuff residue from textile dyeing equipment. In such a process the aqueous admixture, which has a pH of at least about 11.5, consists essentially of water, a base component, a phase transfer agent, and a surfactant. In addition, other constituents such as the reducing agent, the dye carrier, emulsifier, and the like can be incorporated as hereinbefore set forth. The aqueous admixture is then introduced into the textile dyeing equipment which is to be cleaned. The aqueous admixture is heated within the textile dyeing equipment to a temperature of from about 90° C. to about 140° C. As is evident, the temperature can vary widely depending upon the particular composition of the aqueous composition. Further, if desired, the mixture can be heated under pressure and maintained under pressure during the "boil out" procedure. Once the aqueous admixture has been heated to the desired temperature, the aqueous admixture is maintained at such temperature within the textile dyeing equipment for a period of time effectively to allow the phase transfer agent to hydrolyze the oligomer deposits present within the textile dyeing equipment and the surfactant to solubilize the dyestuff residue. While the amount of time can vary widely, I have found that generally such can be readily be accomplished by maintaining the aqueous admixture at its boiling temperature within the textile dyeing equipment for a period of from about 15 minutes to about 90 minutes. Once the prescribed time has passed, the contaminated aqueous admixture, e.g., the aqueous admixture containing the hydrolyzed oligomer deposits and the solubilized dyestuff residue, is then withdrawn from the textile dyeing equipment. It may be desirable to cool the contaminated aqueous admixture prior to removal of same from the textile dyeing equipment for safety reasons. Further, to insure complete removal of all the deposits and residue from the textile dyeing equipment, it may be desirable to flush the textile dyeing equipment with water and/or an aqueous acidic solution after the removal of the contaminated aqueous admixture. Generally it is desired that one flush the textile dyeing equipment with heated water, e.g., water which has been heated from about 50° C. to about 90° C.

Once the contaminated aqueous admixture has been withdrawn from the textile dyeing equipment and if appropriate, the textile dyeing equipment flushed with the warm wash water, and/or an acid scouring solution, the textile dyeing equipment is ready for subsequent dyeing operations.

In order to more fully describe the concept of the subject invention the following examples are given. The examples are given for illustrative purposes only and are not to be construed as unduly limiting the scope of the subject invention as defined in the appended claims. In the examples, unless otherwise indicated, all parts and percentages are parts and percentages by weight.

EXAMPLE I

Ethylene glycol terephthalate trimer was obtained by scooping up several pounds of the material from under processing equipment at a commercial textile plant. The material so obtained was washed with petroleum ether followed by a methanol wash to remove processing aid contaminates such as spin finishes. The washed trimer was then dissolved in heated dioxane and filtered in its heated state to remove particulate impurities. The heated filtrate was then cooled and the trimer crystalized as a fine powder having a melting point of approximately 325° C.

A series of experiments were conducted to determine the degree of hydrolysis of trimer in accordance with the concept of the present invention. These experiments were conducted in Turbomat® laboratory equipment, set at maximum temperature raise and approximately two-thirds of the maximum stirring rate.

In each experiment 200 mg. of the above-described purified and recovered trimer was weighted into an aluminum dish and thereafter transferred to the turbomat container by the use of water. Five hundred grams of water was added to the turbomat container. Other ingredients were added as needed. The turbomat was then set for automatic control and maximum rise in temperature and held at 130° C. for various times, such being determined by measuring the temperature of the circulating oil of the bath. At the conclusion of the experiments the liquid was transferred into a glass jar and examined for trimer residues. Trimer is heavier than water and will fall to the bottom of the container after a very short standing time. In some cases, where incomplete hydrolysis could be observed, spectroscopic examination reveals the amount of terephthalic acid in solution to a fair degree of accuracy. In most cases spectroscopic examination is not necessary because an entirely clear solution is obtained. If the nonionic surfactant is omitted a hazy solution is obtained.

Table I sets forth the results of the above-described experiments. While complete hydrolysis is not obtained with any of the samples, the addition of a nonionic surfactant, a linear $C_{11}$ to $C_{15}$ ethoxylated alcohol having an average of 15 moles of ethylene oxide, is beneficial in the hydrolysis of the trimer.

TABLE I

HYDROLYSIS OF TRIMER IN SODIUM HYDROXIDE SOLUTION CONTAINING A PHASE TRANSFER AGENT

| NaOH Conc. g/liter | Time At 130° C. | 75% solution of dicocodimethyl amine hydrochloride | Nonionic Surfactant | pH | Reducing Agent (thiourea dioxide) | Trimer (1) Hydrolysis |
|---|---|---|---|---|---|---|
| 1.5 | 60 | .0625 g/l | — | 12 | — | Trace(1) |
| 1.5 | 60 | .125 g/l | — | 12 | — | Complete(1) |
| 2.5 | 30 | .125 g/l | — | 12 | — | Trace(1) |
| 2.5 | 60 | .125 g/l | — | 12 | — | Complete(1) |
| 2.5 | 90 | .125 g/l | — | 12 | — | Complete(1) |
| 1.25 | 30 | .0625 g/l | .5 g/l | 12 | — | Incomplete(1) |
| 1.25 | 30 | .125 g/l | 1.0 g/l | 12 | — | Incomplete(1) |
| 2.5 | 15 | .03125 g/l | 1.0 g/l | 12 | — | Incomplete(1) |
| 2.5 | 15 | .0625 g/l | 1.0 g/l | 12 | — | Incomplete(1) |
| 2.5 | 30 | .0625 g/l | 1.0 g/l | 12 | — | Complete(1) |
| 2.5 | 30 | .125 g/l | 1.0 g/l | 12 | — | Complete(1) |
| 1.25 | 30 | .0625 g/l | .5 g/l | 11.5 | .5 g/l | Incomplete(1) |
| 1.25 | 30 | .125 g/l | 1.0 g/l | 11 | 1.0 g/l | Incomplete(1) |
| 2.5 | 15 | .03125 g/l | 1.0 g/l | 12 | 1.0 g/l | Incomplete(1) |
| 2.5 | 30 | .0625 g/l | 1.0 g/l | 12 | 1.0 g/l | Complete(1) |
| 2.5 | 30 | .125 g/l | 1.0 g/l | 12 | 1.0 g/l | Complete(1) |
| 0.75 | 60 | — | — | 12 | — | Incomplete(1) |
| 1.5 | 60 | — | — | 12 | — | Incomplete(1) |
| 2.5 | 60 | — | — | 12 | — | Incomplete(1) |
| 2.5 | 30 | — | 1.0 g/l | 12 | — | Incomplete(1) |

(1) By visual inspection

The above data clearly indicates the hydrolysis of trimer with the aqueous composition of the subject invention at 130° C. under various conditions. Further, the data illustrates that in this set of experiments incomplete hydrolysis is obtained if the sodium hydroxide solution is kept below about 1.5 grams/liter (0.15 weight %) or if the duration of hydrolysis is less than about 15 minutes. In addition, the data further illustrates the addition of a nonionic surfactant is beneficial in the hydrolysis of the trimer.

EXAMPLE II

An experiment was conducted at a commercial textile plant to determine the effectiveness of the concept of the subject invention to remove trimer and dyestuff residue from a kettle. Before the experiment the kettle was examined and determined to have a rim of trimer around the water level in the jet. Further, the trimer was slightly bluish in color and had a pasty consistency. The bluish color was attributed to the fact that a piece of fabric had been dyed blue in the equipment prior to examination of same. The remainder of the interior of the kettle had the typical trimer dust deposits.

The following chemical components and amounts of same were employed in the aqueous composition to clean the kettle.

20 pounds sodium hydroxide as 50% in $H_2O$
3 pounds—thiourea dioxide (reducing agent)
4 pounds—nonionic surfactant (a linear $C_{11}$ to $C_{15}$ ethoxylated alcohol having an average of 15 moles ethylene oxide)
0.5 pounds of phase transfer agent (75% solution of dicocodimethylamine hydrochloride)

In the experiment the jet was filled with about 800 gallons of water (normally for dyeing only about 500 gallons would be employed). The sodium hydroxide and thiourea dioxide were placed in the dye addition tank. The phase transfer agent and surfactant were placed in the chemical addition tank and a small amount of the phase transfer agent was placed in the dyestuff tank. The cycle was then started and at 150° F. the sodium hydroxide and thiourea dioxide were dropped into the kettle, followed by the surfactant and the phase transfer agent. The jet was then heated at maximum raise to 130° C. and held for 20 minutes. It was then cooled and at about 76° C. the aqueous admixture was removed. The kettle was then overflow rinsed for 20 minutes followed by an acid scour.

An inspection was conducted on the kettle after the above-identified cleaning procedure. No trace of trimer or dyestuff residue could be found.

The above data clearly indicates the improved results obtained using the aqueous composition and method of the present invention for removing ethylene glycol terephthalate oligomer deposits and dyestuff residue from textile dyeing equipment.

Having thus described the invention, I claim:

1. A method for removing ethylene glycol terephthalate oligomer deposits and dyestuff residue from textile dyeing equipment which comprises introducing into the textile dyeing equipment an aqueous admixture consisting essentially of water, an effective amount of a base component to provide said aqueous admixture with a pH of at least about 11.5, an effective minor amount of a phase transfer agent to sufficiently catalytically hydrolyze said oligomer deposits present within the textile dyeing equipment, and an effective minor amount of a nonionic surfactant to solubilize said dyestuff residue, heating said aqueous admixture to a temperature of from about 90° C. to about 140° C., maintaining said heated aqueous admixture within the textile dyeing equipment for a period of time effective to hydrolyze said oligomer deposits and solubilize said dyestuff residue and withdrawing the contaminated aqueous admixture from the textile dyeing equipment.

2. The method according to claim 1 further includes incorporating into said aqueous admixture an effective minor amount of a reducing agent to substantially discolor said solubilized dyestuff.

3. The method according to claim 2 wherein said effective minor amount of said phase transfer agent is from about 0.005 to about 0.1 weight percent, said effective minor amount of said surfactant is from about 0.05 to about 0.5 weight percent and said effective minor amount of said reducing agent is from 0.005 to about 1 weight percent.

4. A method for removing ethylene glycol terephthalate oligomer deposits and dyestuff residue from textile dyeing equipment which comprises introducing into the textile dyeing equipment an aqueous admixture consisting essentially of water, an effective amount of a base component to provide said aqueous admixture with a pH of at least about 11.5, an effective minor amount of a phase transfer agent selected from the group consisting of organic quaternary salts and crown ethers to sufficiently catalytically hydrolyze said oligomer deposits present within the textile dyeing equipment, and an effective minor amount of a nonionic surfactant to solubilize said dyestuff residue, heating said aqueous admixture to a temperature of from about 90° C. to about 140° C., maintaining said heated aqueous admixture within the textile dyeing equipment for a period of time effective to hydrolyze said oligomer deposits and solubilize said dyestuff residue and withdrawing the contaminated aqueous admixture from the textile dyeing equipment.

5. The method according to claim 4 wherein the phase transfer agent is an organic quanternary salt having the general formula

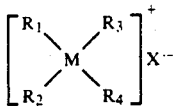

wherein M is a pentavalent ion of an element selected from the group consisting of nitrogen, phosphorous, arsenic, antimony and bismuth, $R_1$, $R_2$, $R_3$ and $R_4$ are alkyl, alkaryl, and aryl, both saturated and unsaturated containing from 1 to about 30 carbon atoms, and X is a halide, sulfate, sulfonate, acetate, or hydroxyl moiety and said organic quaternary salt is further characterized as being substantially heat stable at the temperature at which said aqueous admixture is heated.

6. The method according to claim 5 wherein said base component is an alkali metal hydroxide.

7. The method according to claim 1 which further includes rinsing the textile dyeing equipment after withdrawing the contaminated aqueous admixture from same with water.

8. An aqueous composition for removing ethylene glycol terephthalate oligomer deposits and dyestuff residue from textile dyeing equipment, said aqueous composition having a pH of at least about 11.5 and consisting essentially of water, an effective minor amount of a phase transfer agent sufficient to catalytically hydrolyze said oligomer deposits, from about 0.1 to about 2 weight percent of a base component, from about 0.005 to about 1 weight percent of a reducing agent, from about 0.05 to about 0.5 weight percent of a nonionic surfactant, said surfactant having a cloud point at the concentration employed above the temperature to which the aqueous composition is heated during the use of same for removing the oligomer deposits and dyestuff residue from the textile dyeing equipment.

9. The aqueous composition of claim 8 wherein said base component is an alkali metal hydroxide and said phase transfer agent is selected from the group consisting of organic quaternary salts and crown ethers.

10. An aqueous composition for removing ethylene glycol terephthalate oligomer deposits and dyestuff residue from textile dyeing equipment, said aqueous composition having a pH of at least about 11.5 and consisting essentially of water, an effective minor amount of a phase transfer agent sufficient to catalytically hydrolyze said oligomer deposits which is an organic quaternary salt having the general structure

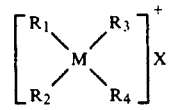

wherein $R_1$, $R_2$, $R_3$ and $R_4$ are alkyl, alkaryl, and aryl, both saturated and unsaturated, moieties containing from 1 to about 30 carbon atoms and X is a halide, sulfate, sulfonate, acetate or hydroxyl moiety, said organic quaternary salt further being characterized as being substantially stable at the temperature to which the aqueous composition is heated during use of same, from about 0.1 to about 2 weight percent of sodium hydroxide, from about 0.05 to about 0.5 weight percent of an ethoxylated linear $C_{11}$ to $C_{15}$ alcohol nonionic surfactant and about 0.005 to about 1 weight percent of thiourea dioxide.

11. The aqueous composition of claim 10 wherein said organic quaternary salt is dicocodimethylamine chloride.

12. The aqueous composition of claim 9 wherein the phase transfer agent is an organic quaternary salt present in an amount from about 0.005 to about 0.1 weight percent.

* * * * *